US005840001A

United States Patent [19]

Schedel

[11] Patent Number: 5,840,001

[45] Date of Patent: Nov. 24, 1998

[54] THERAPY EXERCISE TABLE

[76] Inventor: Robert M. Schedel, 2405 W. 170th St., Torrance, Calif. 90504

[21] Appl. No.: 823,095

[22] Filed: Mar. 24, 1997

[51] Int. Cl.[6] ..... A63H 1/02

[52] U.S. Cl. ..... 482/142; 482/130; 606/242; 606/244

[58] Field of Search ..... 606/237–245; 482/142, 130; 5/62

[56] References Cited

U.S. PATENT DOCUMENTS

| | | | |
|---|---|---|---|
| 599,280 | 9/1898 | Engle | 482/142 |
| 1,046,736 | 12/1912 | Clayton | 606/244 |
| 1,082,043 | 12/1913 | Payne et al. | 606/244 |
| 1,194,939 | 8/1916 | Bishop | 606/244 |
| 1,693,810 | 12/1928 | Daniels et al. | 606/242 |
| 5,050,589 | 9/1991 | Engle | 482/142 |

FOREIGN PATENT DOCUMENTS

| | | | |
|---|---|---|---|
| 131167 | 1/1985 | European Pat. Off. | 606/241 |

*Primary Examiner*—Jerome Donnelly

*Attorney, Agent, or Firm*—John E. Halamka

[57] ABSTRACT

A therapy table, the articulated platform of which may be vertically positioned for ease of mounting by a user, particularly a disabled or injured user. The articulated platform separately supports the lower and upper body of the user. A foot rest platform is provided at the lower end of the platform for the user to initially mount the table. A leg locking arrangement secures the user to the foot rest platform and table during foot rest platform positioning of the user in vertical relationship to the articulated platform. The platform may be rotated to an essentially horizontal position. The upper body support portion of the platform may be moved away from the user whereby the user may perform selected exercises such as hyper extension of the lower back. Weights may be made accessible to the user to allow conditioning of selected muscle regions. The design and use of this table is particularly adapted to reduce the stress of therapy for a user having an injured back. The movements of the selected portions of the table, distance and rate, are performed by actuators under the control of the patient or therapist. The base upon which the articulated platform is mounted may be foldable so that the therapy table requires minimum space for storage.

17 Claims, 6 Drawing Sheets

THERAPY EXERCISE TABLE

FIELD OF THE INVENTION

The present invention relates to the field of exercise apparatuses which may be used for general health as well as specific therapeutic purposes. This device is particularly adapted to permit use by those with physical impairments that may prevent them from utilizing other exercise apparatuses. In particular, this device enables anyone, with or without a physical impairment, to improve the condition of the skeletal and muscular areas of the spinal column. This is achieved by a regimen combining controlled gravitational distention of the spinal column to relieve the gravitational pressure on the vertebrae and discs while the subject simultaneously actively flexes the related musculature structure repetitively to improve both its condition and strength. The user may seek the advice of a licensed person such as a therapist or doctor for the precise type of exercise for a specific malady experienced by the user.

The elements of this device are particularly adapted for easy mounting and dismounting as well as configuration for performance of lower back stretching and strengthening therapy and exercises for selected portions of the back as well as the gluteal region.

BACKGROUND OF THE INVENTION

Many therapeutic, exercise apparatuses have been developed, each targeted to a specific area or areas of the body. Most of the therapeutic or exercise apparatuses have required the user to mount a table, bench, chair or specific part of the apparatus in order to perform the recommended exercise or be in a position for therapy.

Some potential users may lack the ability to utilize such apparatuses, independently or with human or mechanical assistance, because of physical impairment. If the spine (used here as including the bones, disks and supporting muscles) of the user is injured, the spine demands delicate care for effective therapy.

The ability of a person to stand upright without pain depends upon the proper alignment of the vertebrae and the strength and condition of the associated musculature. Upper vertebrae that are an integral part of the rib structure maintain relatively good stability, support and spacing. The lower portion of the spine (the lumbar region) that is not an integral part of the rib structure relies primarily on the condition and strength of the related musculature to provide the proper alignment and spacing of the vertebrae. Strong gluteal muscles assist the functioning of the lumbar region.

Misalignment or compression of the vertebrae produces symptoms ranging from back aches of varying severity and duration to paralysis depending on the nature and cause of the misalignment. These symptoms are exacerbated by any remedy requiring the subject to perform procedures while in an upright position which effectively intensifies the gravitational compression on the vertebrae and discs, thereby causing additional pain and discomfort. As a consequence, the additional pain and discomfort results in a rejection or inability of the subject to apply the procedures intended to remedy the causal problem.

The controls and adjustments of this invention make possible ease of access and use, even for those with impaired mobility, and enables the user to regain the proper alignment of the spine and strength of the related musculature structure. These benefits can be applied to general or specific areas of the spinal column as desired and where such a potential benefits may be possible.

The device illustrated by this invention allows the user to have easy and safe access to the device in an upright position. After adjustment for individual physical characteristics, the table with the subject properly positioned, is then rotated to a prone position mechanically which relieves the spinal column of the lateral compression on the vertebrae and discs. In this position, the subject is lying face down while grasping the extended handlebars. The front section of the table bearing the upper torso of the subject is then retracted downward to the desired angle that utilizes gravity to relieve the compression on the vertebrae and discs while simultaneously distending the vertebrae and decompressing the discs. Remedial exercises while in this suspended position benefits the specific musculature in need of improved strength and health.

The potential short term benefits to the subject utilizing this device are early relief from the discomfort caused by misalignment of the vertebrae and/or compressed discs. Potential long term benefits are restoration of the required strength of the musculature essential for maintaining the appropriate alignment of the spinal column and spacing of the discs along with the attendant freedom of motion and activity.

Although the normal standing position intensifies the weight required to be supported by the spine, the lattice of the spine and muscle structure usually allows the person to stand upright without pain as the weight of the upper body is distributed through the spinal column. It is the slightest movement of bending over which disturbs the lattice or the additional loading of the lattice which unpredictably causes pain. Because of the constant threat or fear of pain, the person may refrain from performing exercise or therapy to strengthen the lattice. If the spine is placed into a hanging position (hyper extension), at least from the waist up (torso), this vertical positioning of the user's spine allows the vertebrae and supporting muscles to stretch. This vertical positioning relieves the pressure on the vertebrae and disks and may eliminate the pain sufficiently to allow the user to perform exercise which strengthen the lumbar region and the gluteal muscles. Upon sufficient strengthening, the selected region may maintain a strong lattice to allow the person to tolerate the previously avoided small bending movements and increase in load.

The present invention has solved the problem of allowing a user (a patient by themselves or in conjunction with a therapist) even if the user is incapacitated by back pain, to mount and be positioned on the therapeutic exercise device illustrated herein. The user may then perform exercises or receive therapy which may relieve the pain. After the session is completed the user may be positioned for dismounting from the device in a method which drastically reduces or eliminates any pain from this maneuver.

Several have attempted to solve the problem. U.S. Pat. No. 5,190,513 ('513) is a device upon which the user may perform hyper extensions. However, the user must be initially fit and flexible enough to mount the device by raising one leg over the front base member 42 and move into a position whereby the hips engage support pads 26 and the legs engage support pads 32 while maintaining sufficient lower back strength to avoid falling forward onto the back pad 18 as all of the upper body weight must be supported by the lower lumbar region being held rigid until the upper body is lowered to a hyper extension position. While back pad 18 is adjustable over a range of positions, this adjustment is suggested by '513 to attain the desired declination angle for sit-up exercise, not hyper extension exercise.

The device illustrated by U.S. Pat. No. 5,125,884 ('884) requires that the users ankles be secured to the device before adjusting the position of the bench from a horizontal position to a desired position. The '884 device also requires the user to be flexible enough to swing a leg over the device, sit down and adjust the padded roll 23 to secure the user's ankles into the device. The use of '884 requires the user to only be positioned face up. Thus when the bench is positioned from horizontal to semi-vertical, the user's back is fully supported by the bench surface which cannot be removed or repositioned. Hence, the user cannot be placed in a position to hyper extend the lumbar region.

U.S. Pat. No. 4,232,662 ('662) attempts to solve the problem of tilting the body to different angular positions. The teaching contained in '662 requires the user to mount and use the device without assistance. The platform 58 is positioned for supporting the back after the user's ankles are secured within the lower portion of the device. As with the '884 device above, with the platform 58 supporting the back, the user's body cannot be positioned to allow hyper extension of the lumbar region. Although it appears possible for the user to mount the device with the platform 58 supporting the upper body portion of the user, the user must be flexible and pain free enough to secure the ankles to the lower body supporting portion and then stand up. The '662 device can now be rotated to allow the lumbar region to positioned vertically. However, as the platform 58 is not movable or removable from supporting the front of the user, a true position for hyper extension of the lumbar area cannot be achieved with the '662 device. Further, as the '662 device does not illustrate or even suggest any method to lock the platform into a selected position or support the user's body from the waist down while attempting use of the '662 device as an exercise or therapeutic device for body from the waist up. Use of this device for treatment of the lumbar area may exacerbate the user's condition.

Soviet Union Patent SU 1644-982-A ('982) allows the user to step up into the device and have the user's ankles secured to hold the user while the platform 18 is rotated in a manner similar to the '662 device above. The '982 device provides for a folding of the platform 18 at or near the user's waist. The folding is in a direction to allow sit up exercises but not hyper extension activity. Further, as with the '662 device, '982 does not teach the use of any locking means to hold the '982 device from free rotation. The '982 device illustrates exercise of the abdominals and does not even suggest use of the device for the lumbar or gluteal region.

U.S. Pat. No. 4,292,962 teaches the use of a device incorporating a platform 14 having foot rests 34 and a calf restraint bar 50 in combination with a positionable platform 56 which supports the user from the waist down while allowing the upper body to be supported by a chest support cushion 42. The platform 14 is attached to a stand 12 by means of a pivotal axis 72. '962 teaches that the user may position his arms to cause the platform 14 to be rotated to a position selected by the user. However, once the user moves his arms the position of the platform 14 is free to change. The platform is not stable and no locking or positioning devices are even suggested by '962. Thus, '962 cannot be secured into a position to allow the user to perform therapy such as the hyper extension exercise of the lumbar or gluteal area.

U.S. Pat. No. 4,059,255 ('255) teaches the tilting of a therapy table from a horizontal position to near vertical. The user may then step upon a platform 14 facing the padded table or with his back supported by the padded table to be tilted to a horizontal position. '255 does not teach restraining the user to the device for positioning. Further, '255 does not teach adjustment, positioning or removal of the rigid platform of pads and thus '255 cannot be used to perform hyper extension exercise.

U.S. Pat. No. 2,630,800 ('800) teaches rotation of the table frame 12 from a horizontal position to an almost vertical position for mounting by the user to be positioned horizontally on support pads 65 and 71. The support pads 65 and 71 are slidably adjustable but cannot be removed to allow the user to perform hyper extension exercise. Although '800 teaches restraining the user to the device, the restraint system illustrated is for the purpose of applying traction to the user not exercise or stretching initiated by the user.

U.S. Pat. No. 5,518,487 ('487) attempts to solve the problem by combining an tiltable bench pad 110 with accessories to allow the user to perform hyper extension exercises. However, the support system disclosed by '487 does not allow the bench to be positioned for ease of mounting by the user in a manner similar to '800 or '255 above. Further, '487 does not teach supporting of the upper body while placing the hips on the bench in a position to perform the hyper extension exercise or exercise of the gluteal muscles.

Thus there has long been a need for a device which provides a method to mount, perform a physical therapy or conditioning work-out session and dismount without imposing a load on the spinal column, particularly the lumbar region.

SUMMARY OF THE INVENTION

Accordingly, the objectives of this invention are:

a. To provide a device which allows the user to exercise selected regions of the muscles of the back (with particular emphasis on the lumbar region or gluteal muscles) in a manner which avoids or minimizes any pressure on or potential to load the spinal column thereby causing any additional pain or damage to the selected region;

b. To provide a device which will allow a user to perform pain free exercising of the lower back or gluteal muscles sufficiently to promote the recovery of the user by allowing the muscular/skeletal system of the lower back to become stronger thereby accelerating the users ability to function in daily life relatively pain free;

c. To provide a therapy table easily mountable by the user which places the user in a position to perform hyper extension exercise of the lower back muscles and strengthening of the gluteal muscles with minimal exposure to pain; and, d. To provide a therapy table which allows a user to be positioned on the chest and stomach thereby allowing open and free exercise of the selected upper, middle or lower back muscles without loading the spine with the weight of additional exercise equipment (e.g. dumbbells, pulleys and weights) and use one's own body weight, however additional weights are available to the user to achieve increased strengthening and toning of the selected region;

The above and other objects of the present invention are achieved, according to a preferred embodiment thereof, by providing an essentially vertical, articulated body platform having a powered foot rest upon which the user may step and be vertically positioned against the body platform. After being positioned, the user may be secured to the body platform. The body platform may be rotated from vertical to place the user in a horizontal position for therapy. After the horizontal positioning is achieved, the upper portion of the articulated body platform may be rotated at a controlled speed to place the user in a hyper-extended position. The user may then perform selected strengthening exercises for the lumbar or gluteal muscles. After completion of the exercises, the upper portion of the platform may be moved to support the user and the user may be rotated to an essentially vertical position. The user is then lowered to the floor level by the powered foot rest. The user may now be unsecured from the platform to step off and away from the platform, all in a method which does not stress the spinal column.

The base of the device may be fabricated of longitudinal and vertical supports spaced apart to provide a steady, tip free support for the platform. One embodiment shows the use of angled supports generally L shaped. This base may be used in limited space and could be constructed to fold up like a ladder for storage during non-use of the device.

The platform of the device is fabricated in selectively shaped upper body and lower body sections which may move in tandem or separately. The integration of power assisted actuators to control the movements of selected portions of the apparatus allow the user or therapist to select a beneficial attitude of the user/patient without exertion by the user or therapist.

Weights may be attached to the platform to be accessible to the user directly or through a cable and adjustable pulley assembly to allow exercise of the upper and middle back muscles at a wide range of angles, the setting preselected to concentrate the exercise on a particular region of muscles, while protecting the user from pain because these weights will not be loaded on the spinal column to depress or further damage irritated vertebra disk sections while allowing an increase in the load moved by the user during the exercise activity.

BRIEF DESCRIPTION OF THE DRAWINGS

The above and other embodiments of the present invention may be more fully understood from the following detailed description, taken together with the accompanying drawing, wherein similar reference characters refer to similar elements throughout, and in which.

DESCRIPTION OF A PREFERRED EMBODIMENT

Figure 1:
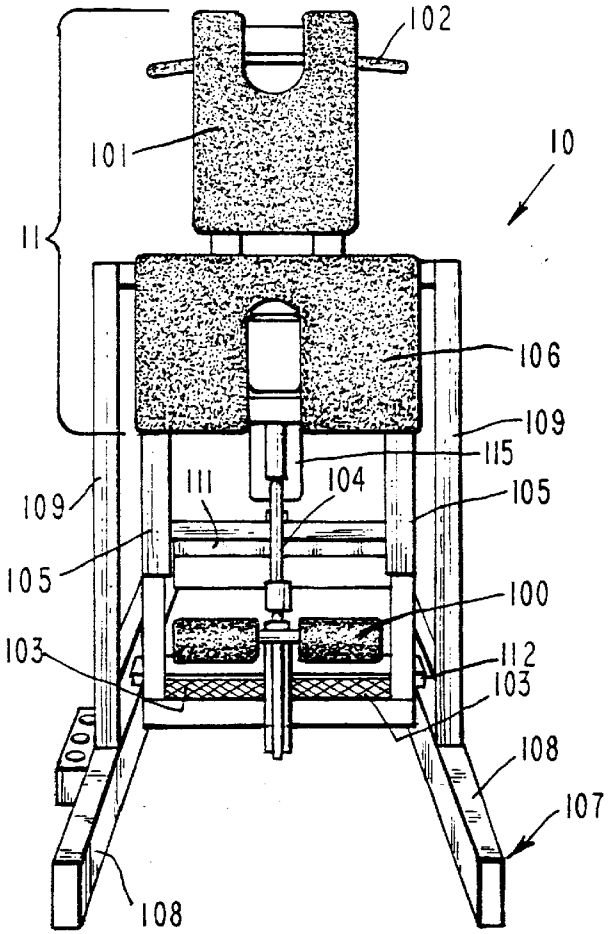
FIG. 1 represents a front perspective view of the present invention in the vertical position.

Referring now to the drawing, there is illustrated in FIG. 1 a front view as a user would initially approach the platform 11 of the therapeutic table, generally designated 10. The platform 11 is shown in the vertical position. FIG. 1 shows the leg locking pad arrangement 100 installed.

Figure 6:
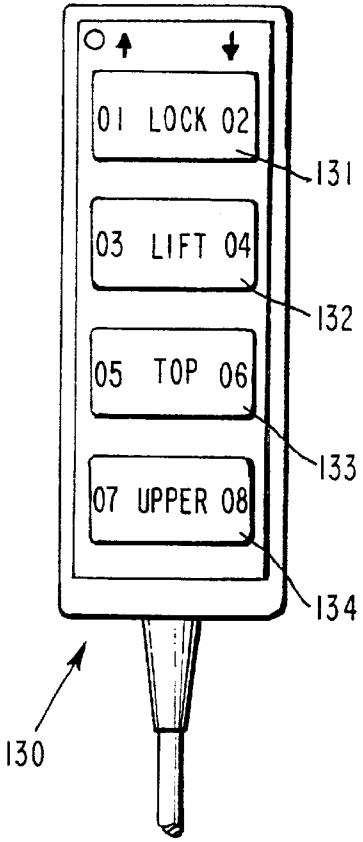
FIG. 6 represents a general arrangement of position control.
Figure 4:
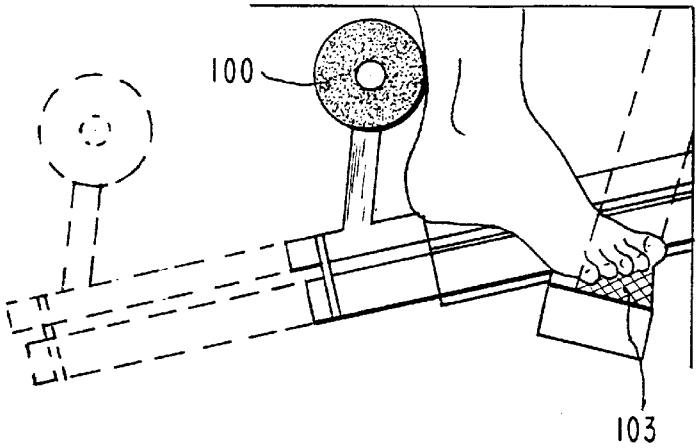
FIG. 4 illustrates the user retaining system.

For ease of access by the user to the therapeutic table 10, the leg locking pad 100 is slidably mounted so that it may be moved away from the foot rest platform 103 to allow the user to easily approach the therapeutic table 10 until the chest of the user is resting on the upper body support pad 101 of the platform 11. The user may grasp the handle 102 for stability while placing each foot upon the respective right/left side of the foot rest platform 103. The therapist may then move the padded leg locking arrangement 100 directly behind the user's feet to comfortably secure the feet of the user to the therapy table 10. This insertable and movable portion of the leg locking arrangement 100 may be placed under the control of an actuator so that the user or therapist may be able to control 131 the movement to position this portion of the device. The securing of the user's feet to the device is more easily understood by consulting FIG. 4. All actuator controls for the positioning of selected elements of the arrangement 100 may be made available to the user for use of the device without a therapist. However, the initial use of the device should be in conjunction with a therapist who retains total control of the positioning of the elements of the arrangement 100. As used herein the patient by himself or the patient and therapist collectively are referred to as the user FIG. 6 illustrates a cluster of controls, generally designated 130, which may be implemented for each of the actuator movable element or function of the device. Each control may be electrically connected to a preselected actuator. The actuator may be hydraulic, electrical, a step motor controlled screw, etc. If the actuator is electronic, the actuator may contain a servo motor with encoder to allow selection of position, direction and slew rate of the actuator.

The leg locking control 131 may tighten (01) or release (02) the leg locking arrangement 100. The foot rest height 132 may be adjusted up (03) or down (04). The table attitude 133 may be adjusted toward horizontal (05) or toward vertical (06). The upper body support may be positioned 134 lower (07) or higher (08).

Figure 3:
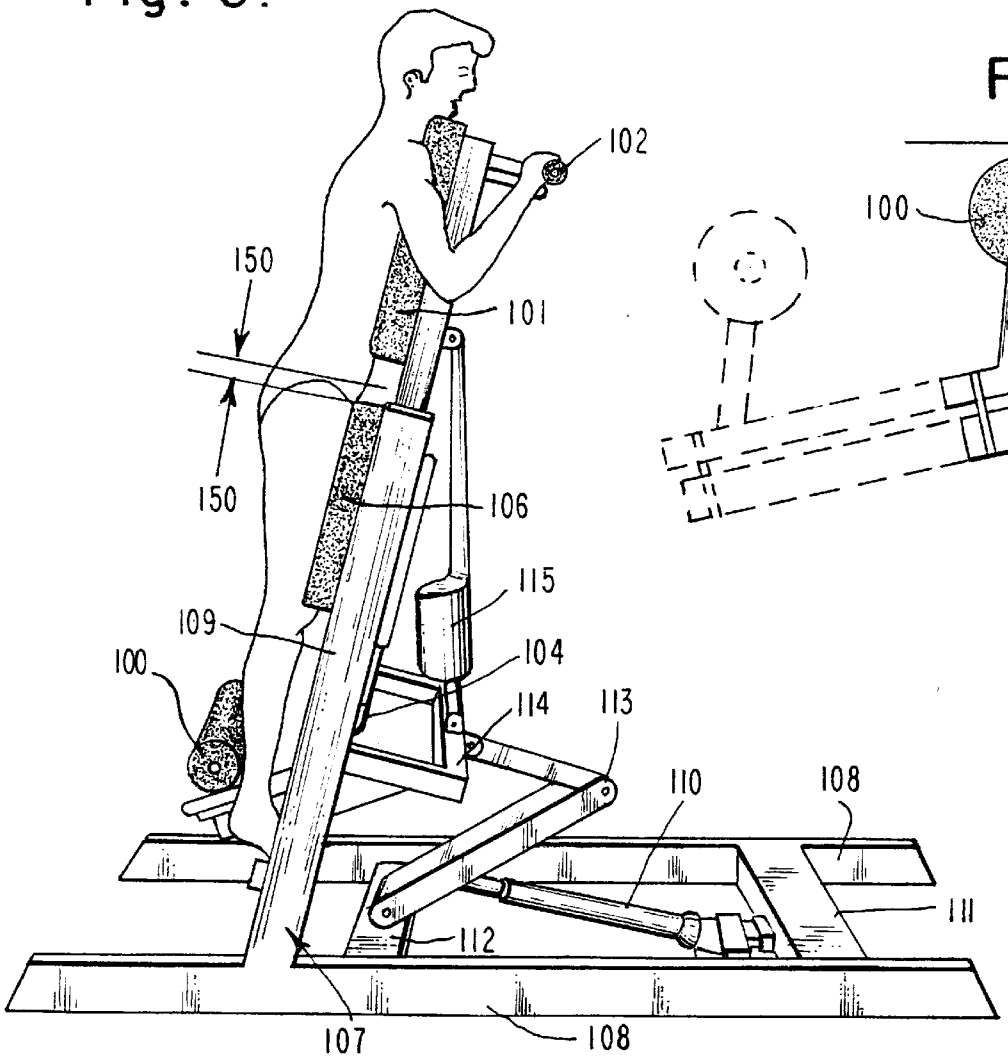
FIG. 3 represents a side perspective view of the present invention with a user positioned at the initial mounting of the device.

Referring to FIG. 3, a foot rest actuator means 104 may be controlled 132 by the user or therapist to increase the height of the foot rest platform 103 above the floor to place the pelvis of the user in a preselected position 150 on the therapeutic table. Placement of the pelvis is particularly importing for selecting the amount of strengthening exercise performed on the gluteal muscles.

Figure 2:
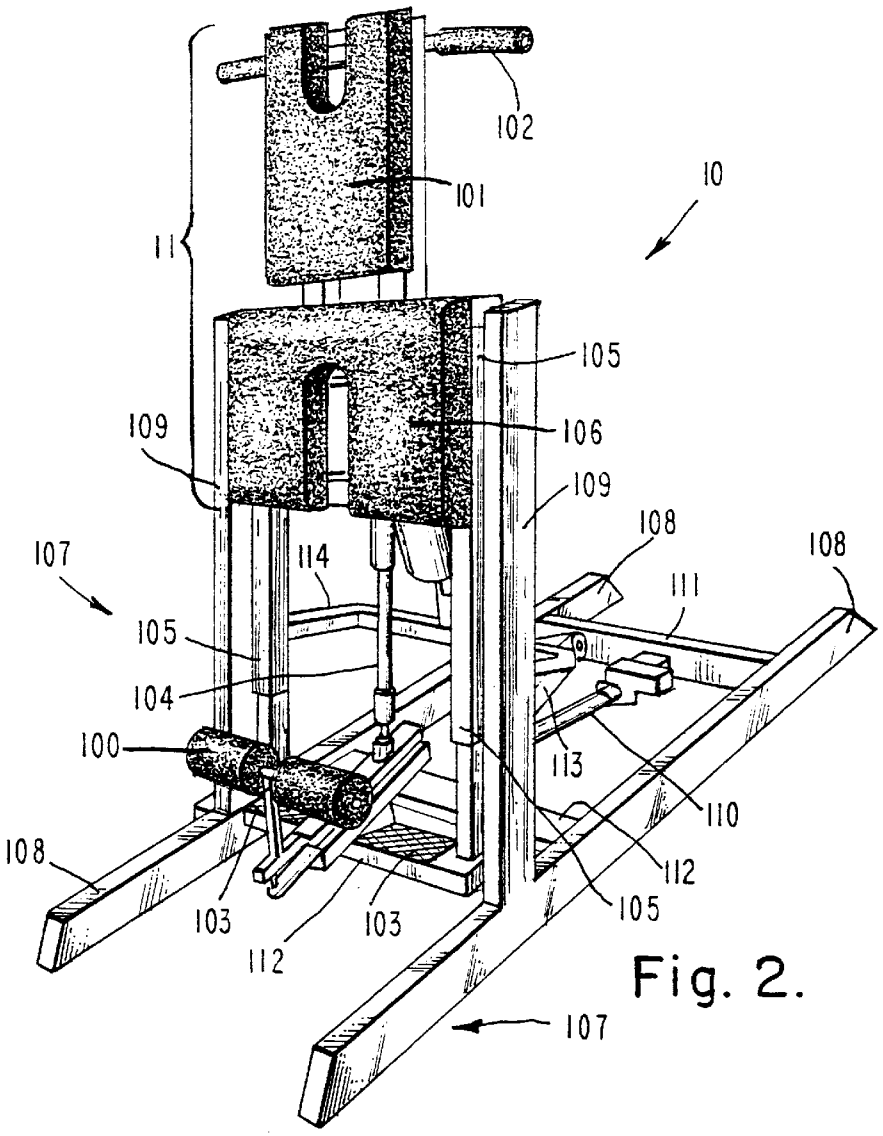
FIG. 2 illustrates another perspective view of the present invention.

As shown in FIG. 2, the each edge support of the foot rest platform 103 is fabricated to telescope into the lower body support 105 as the foot rest actuator 104 is powered to move the pelvis of the user to a preselected position on the pelvis support pad 106 portion of the platform 11. Further illustrated is how the padded leg locking arrangement 100 may be inserted above the foot rest platform 103 to comfortably engage the legs of the user within the device 10 prior to horizontally positioning the user.

The pelvis support pad 106 is fabricated in a preselected shape to be ergonomically compatible with the front pelvic section of the user's body which generally contacts the pad 106. Of course the table may also be utilized for selected exercise with the user lying on his back particularly if the user can mount the platform in the horizontal position.

The position 150 of the pelvis of the user may be selected to be even with the top edge of the pelvis support pad 106. This is the preferred position to treat the lower back muscles (lumbar area). The precise position is dependent upon the user's muscular and skeletal features and may require some experimentation to establish the most beneficial position. Once the preferred position is established for a user, the position can be easily duplicated on subsequent therapy sessions.

The higher the users hipbone is positioned above this leading edge, the more intense the workout will be for the gluteal muscles (a maximum distance of 2 inches above the leading edge is recommended).

The lower body support platform 105 is pivotally mounted 140 to a base, generally designated 107, which, in the preferred embodiment, is fabricated of a pair of longitudinal supports 108 separated by end and middle spacers 111 and 112 respectively. A single spacer may be utilized with sufficient strength of attachment of the spacer to the longitudinal supports 108 to provide a ridged support. A pair of vertical supports 109 are mounted to the longitudinal supports 108. All of the supports are fabricated of a size and strength to provide a stable base 107 sufficient to support the preselected weight of a user/patient and maintain stability during positioning of the user. For the preferred embodiment, the maximum weight of a user was chosen as 400 pounds.

Figure 10:
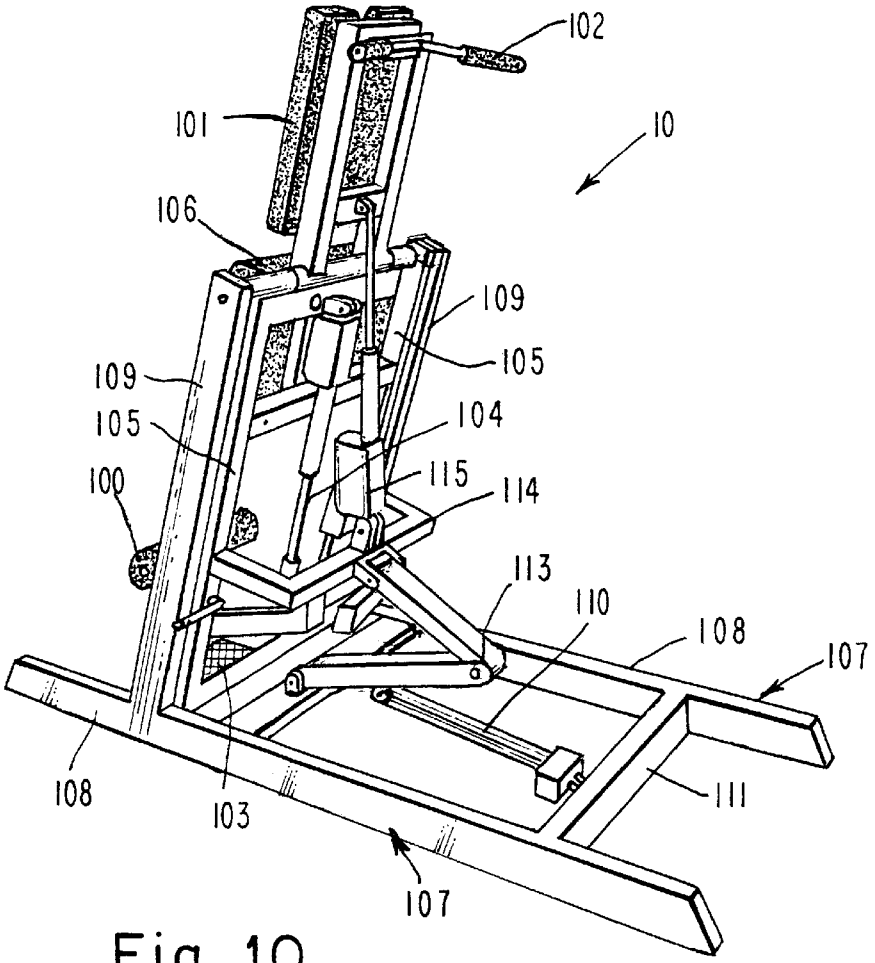
FIG. 10 illustrates a rearward view of the therapeutic table.

After the user is secured to the therapeutic table 10 in the initial vertical position, the user may utilize the control 133 to engage the platform actuator 110 to tilt the combined upper body support pad 101 and lower body support 105 to a selected attitude, e.g. horizontal. The positioning mechanism and function is best shown in FIGS. 3 and 10. The positioning mechanism may be designed to place the user beyond the horizontal position illustrated in FIG. 5.

Figure 5:
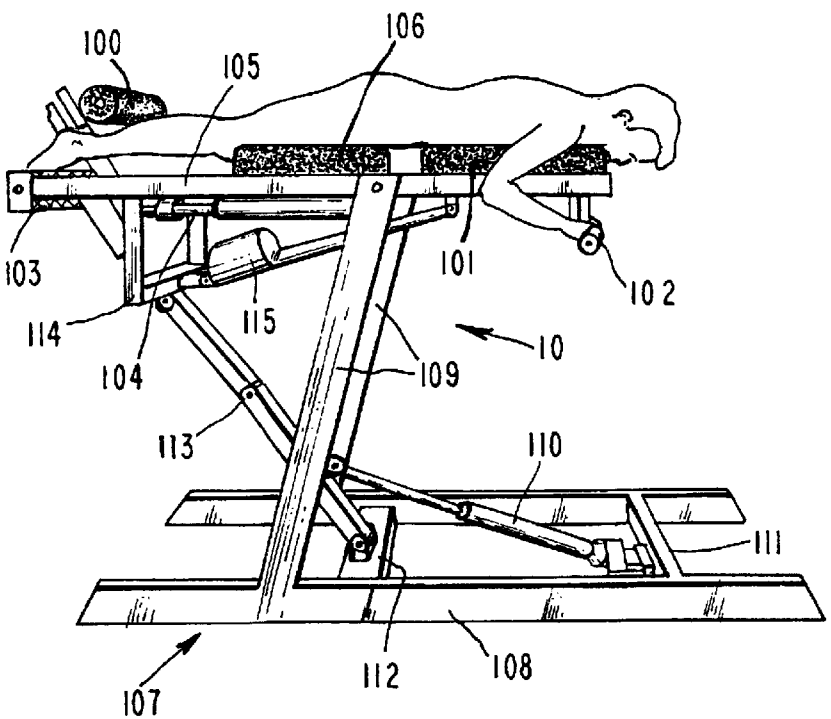
FIG. 5 illustrates the user in a horizontal position.

An articulated platform support arm 113 is mounted by one end to a spacer, in this illustration it is the middle spacer 112, and by the other end to a U shaped platform support 114. One end of the platform actuator 110 is mounted to the articulated platform support arm 113 and the other end of the actuator 110 is mounted to a spacer, in this illustration it is attached to the end spacer 111. Upon engaging the actuator 110 through the control 133 (toward horizontal 05, toward vertical 06), the articulated arm 113 is pushed from the hinged position shown in FIG. 3 into a near vertical position as shown in FIG. 5 thereby positioning the upper and lower body support platforms 101 and 105 from a vertical to a horizontal attitude.

This arrangement is illustrative of one configuration of the spacers and actuator. Of course spacers 111 and 112 could be combined to provide stability to the longitudinal supports 108 and provide sufficient surface to mount the articulated platform support arm 113 and the platform actuator 110.

Figure 7:
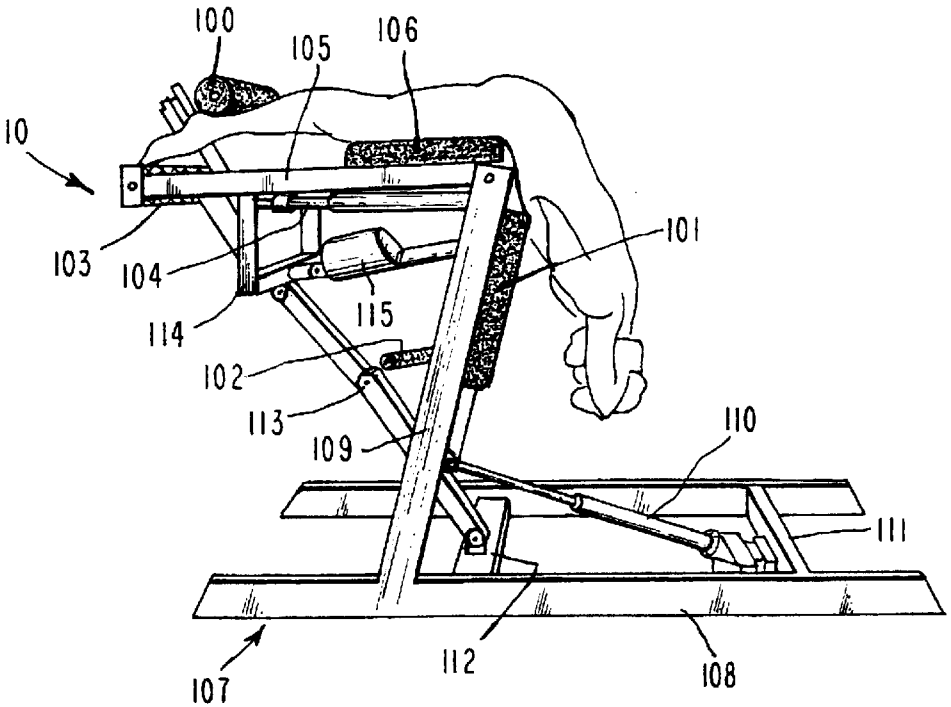
FIG. 7 illustrates the user in the hyper-extended position.
Figure 8:
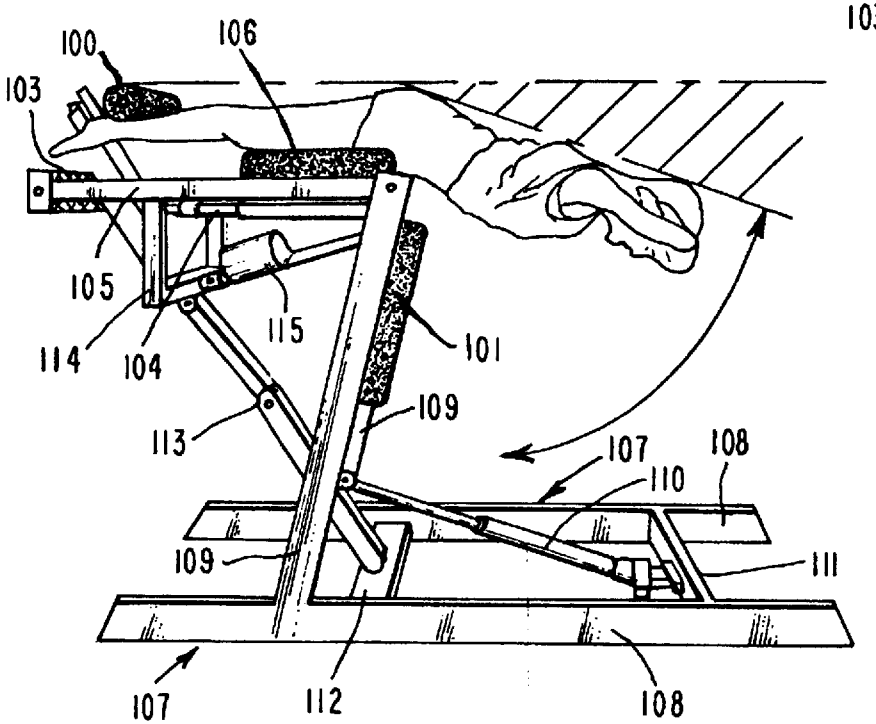
FIG. 8 illustrates the removal of a portion of the platform to allow exercise by the user.

The upper platform actuator 115 is attached by one end to the U shaped platform support 114 and by the other end to the upper body support platform 101. The actuator 115 may be controlled 134 (lowering 07 or lifting up 08) by the user to move the upper body support platform 101 a preselected distance at a preselected rate from the horizontal position shown is FIG. 5 to a vertical position shown in FIGS. 7 and 8. The patient may be moved with the platform from horizontal to the hyper-extended position shown in FIG. 7. The upper body support platform 101 is positioned the maximum distance from the user to allow the user to perform lower back or gluteus exercise and strengthening movements as illustrated in FIG. 8. The control 134 of the upper platform actuator 115 allows the upper body support platform 101 to be positioned anywhere between FIG. 5 horizontal and FIG. 7 vertical so that the user may gradually build from small angle body movements to large angle body movements illustrated in FIG. 8. The user should not exercise at the angles shown in the shaded portion of FIG. 8 as such activity may harm the vertebra and disks and cause spinal pain.

Figure 9:
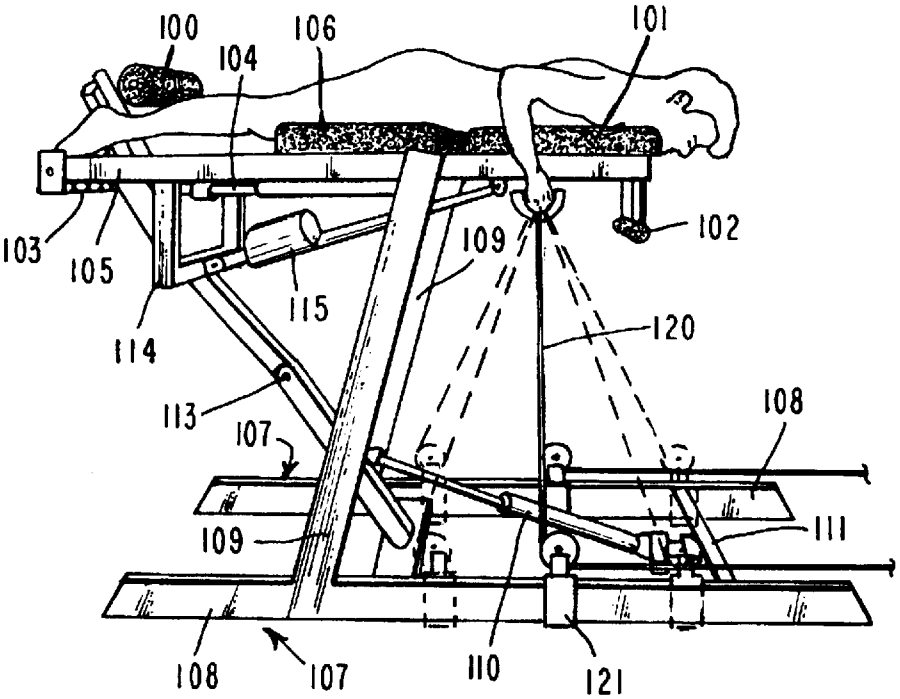
FIG. 9 illustrates additional weights available through cables and pulleys to the user; for exercising of the upper and middle back muscle groups.

FIG. 9 illustrates the mounting of additional weight means 120 on the therapeutic table 10 and accessible to the user for additional upper body exercises. If the user has a damaged lumbar region or is experiencing pain in that region, the user may be prevented from exercising the upper and middle back muscles especially with weights. The positioning of the user with this arrangement 10 allows the user to perform exercise with weights without adding stress to the spinal column. The weights for additional upper body exercise means 120 may include handles, cables, pulleys 121 and holders for free weights. The pulleys 121 are slidable mounted to the longitudinal support 108 whereby the angle of resistance may be preselected to allow a selected back muscle region to be exercised by movement of the weights. Further selection of the region of the back muscles to be exercised may be obtained by positioning the platform 11 away from horizontal thereby allowing isolated selection of m. latissimus and m. trapezius as well as shoulders, deltoids and even biceps with the elimination of any pressure on the spinal column After the workout the user is repositioned from the horizontal position to the original vertical position, the foot rest platform 103 is lowered to the floor and the leg locking arrangement 100 is removed. The user may then step away from contact with the therapeutic device 10 without any strain of trying to dismount from the horizontally positioned platform.

FIG. 10 illustrates the rear view of the device with the platform 11 in the vertical position ready for the user to approach.

Figure 11:
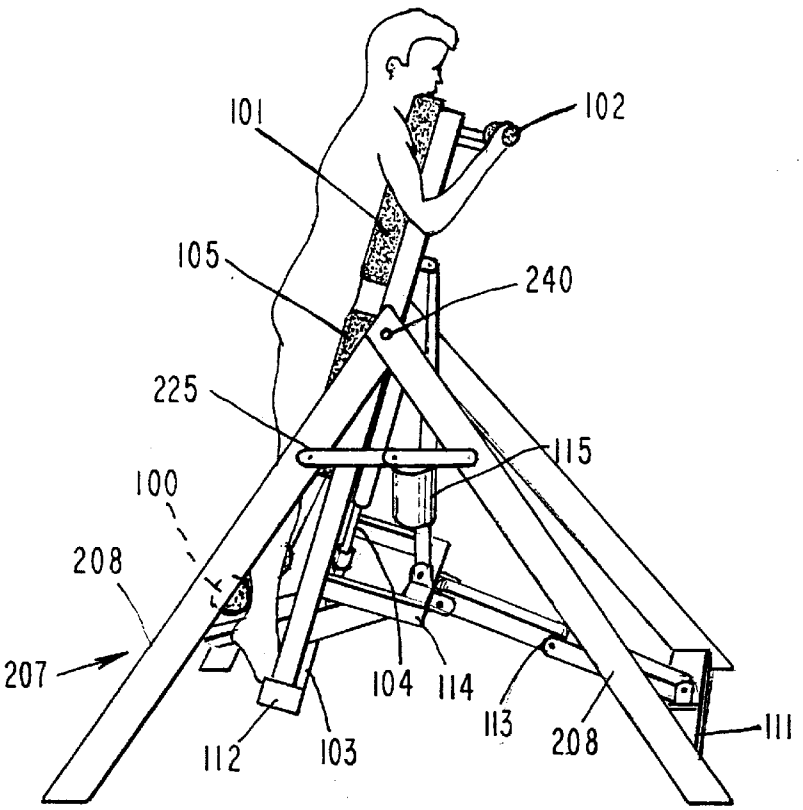
FIG. 11 illustrates another embodiment of the base for the platform with the platform near vertical.
Figure 12:
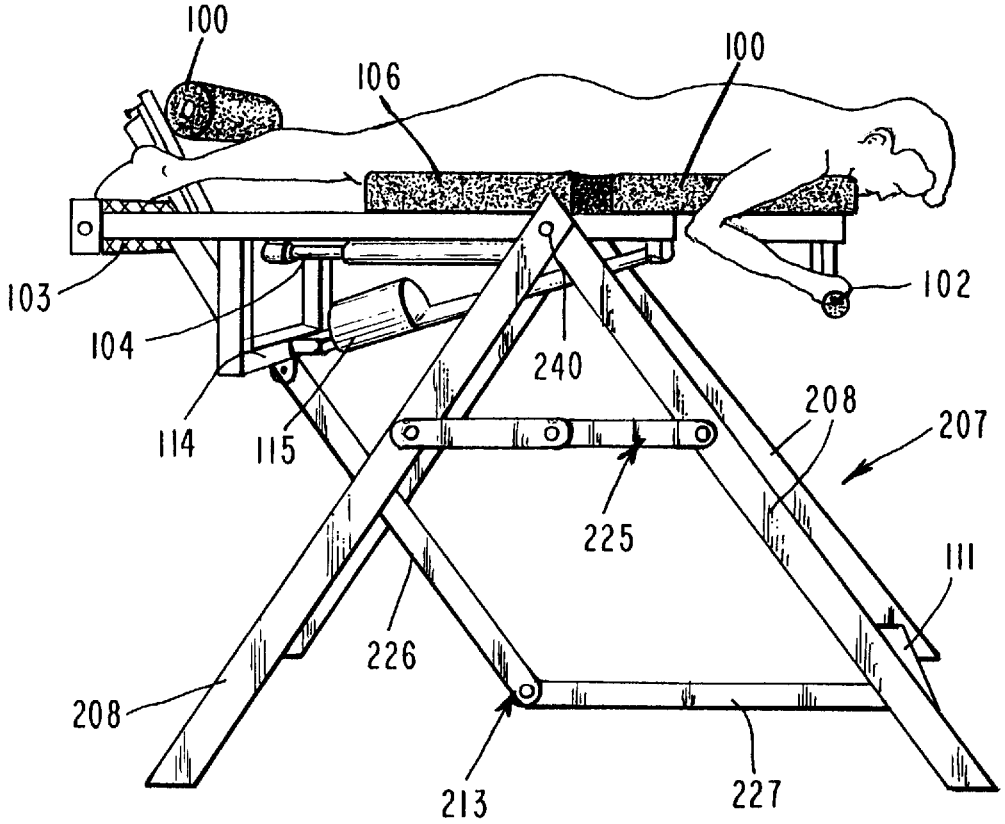
FIG. 12 illustrates the other embodiment of the base with the platform near horizontal.

FIGS. 11 and 12 illustrate another embodiment of the base generally designated 207 fabricated of generally L shaped supports 208 held in spaced apart configuration by a spacer 211. The platform, lower body support 105 and upper body support 106, as described above is pivotally mounted to the base 207 whereby the platform may be used as described above.

The base 207 may be fabricated with the L shaped legs hingedly connected at the apex whereby the legs may be folded together for storage of the device when not in use. An articulated spacer arm 225 may be mounted to each side of the base 207 to hold each L shaped leg in a spaced apart configuration similar to a ladder. A set of wheels or rollers (not shown) which may be locked in place during use of the device may be mounted to the base 207 to allow the device to be pushed to a convenient storage area when the device is not in use.

The positioning of the platform 105/106 is performed by movement of the articulated platform support arm 213. As described in the above embodiment, one end of the articulated platform support arm 213 is mounted to the spacer 211 and the other end of the arm 213 is mounted to the U shaped platform support 114. The arm 213 is fabricated of a generally horizontal arm portion 227 and a generally vertical arm portion 226. FIG. 12 illustrates the extended position of the support arm 213 to position the platform horizontally. This configuration of the articulated support arm 213 is preferred to keep the arm 213 in a remote position during hyper extension exercise thereby reducing contact by the user with the arm 213.

The horizontal arm 227 and vertical arm 226 are under actuator control, similar to that described in the above embodiment, whereby the combined position and length of each arm 226/227 will position the platform to the user selected attitude.

As discussed above, additional weight means 102 may be mounted to the base 207.

Since certain change may be made in the above apparatus without departing from the scope of the invention herein involved, it is intended that all matter contained in the above description, as shown in the accompanying drawing, shall be interpreted in an illustrative, and not a limiting sense.

What is claimed is:

1. A positionable therapeutic table arrangement comprising, in combination:

a base;

a platform rotatible mounted to said base, said platform having a pelvis support portion and an upper body support portion which may be rotated in tandem from at least a near vertical position to a horizontal position in relation to the floor upon which said therapeutic table is installed;

a foot rest platform moveably supported below said pelvis support portion of said platform whereby said foot rest platform is positionable to near floor level for easy mounting by a user and thereafter said foot rest platform and user are vertically positionable in relation to said pelvis support portion of said platform;

a leg-locking arrangement slidably mountable to said foot rest platform to secure the user to said platform for said vertical as well as any subsequent positioning of the user;

platform positioning means whereby said platform may be rotated to a selected attitude from a near vertical through horizontal to a selected attitude and maintained securely at the preselected attitude;

upper body support positioning means whereby said upper body support portion of said platform may be positioned from said selected attitude to a preselected distance away from the user whereby the user may perform a selected exercise, thereafter said upper body support may be repositioned to support the user in said preselected attitude whereafter said platform positioning means may be engaged to position the user back to the initial vertical position so that the foot rest may then be lowered and padded leg locking unclamped to allow the user to exit the device by stepping away without having to dismount from the selected, non-vertical position of the platform.

2. The arrangement defined in claim 1 wherein said base further comprises a preselected number of longitudinal supports securely held spaced apart by a preselected number of spacers, a preselected number of vertical supports having a first end and a second end, each said vertical support mounted by said first end to one of said longitudinal supports and having a pivotal mount on the second end remote from said longitudinal support whereby said platform may be attached to said vertical support and rotated to a preselected attitude.

3. The arrangement defined in claim 2 further comprising a generally U shaped platform support mounted on the underside of said pelvis support portion of said platform.

4. The base in claim 2 wherein said supports and said spacers are fabricated to support a preselected weight of the user.

5. The base in claim 2 wherein said preselected spacers comprise at least an end spacer and a middle spacer.

6. The arrangement in claim 1 wherein said pelvis support portion of said platform is fabricated of a preselected shape and padding is mounted on the upper surface thereof.

7. The arrangement in claim 1 wherein said upper body support portion of said platform is fabricated of a preselected shape, padding is mounted on the upper surface and a handle, accessible to the user, is mounted on the lower surface thereof.

8. The arrangement in claim 3 wherein said rotation of said platform to a preselected attitude is controlled by means of a powered actuator accessible to the user and responsive to control the amount and speed of rotation to a preselected attitude and thereby stabilize said platform in said a user selected attitude, said actuator having a first end and a second end, said first end mounted to said spacer and the second end mountable to an articulated arm, said articulated arm having one end mounted to said spacer and the other end remote from said spacer mounted to said U shaped platform support whereby said articulated arm is moved by said powered actuator from a hinged position to a generally vertical position thereby moving said platform from a generally vertical to a generally horizontal attitude.

9. The arrangement defined in claim 1 wherein said leg locking arrangement further comprises padding to comfortably secure the user to said platform and an actuator whereby the slidable position of said leg locking arrangement is responsive to being controlled by the user.

10. The arrangement defined in claim 1 wherein the vertical position of said foot rest platform is positionable by an actuator, the control of which is accessible to user.

11. The arrangement defined in claim 1 wherein the attitude from horizontal to vertical of said upper body support is positionable by an actuator, the control of which is accessible to the user.

12. The arrangement defined in claim 1 wherein the movable portions of the device are placed in preselected positions by a preselected type of actuator which may provide control of position as well as rate of movement of the selected portion.

13. The arrangement defined in claim 12 wherein the controls of said actuators are clustered and accessible to the user.

14. The arrangement defined in claim 12 wherein said actuators are electrically controlled motors with encoders, said motors mounted to screw type positioners thereby allowing selection of position, direction and slew rate of the actuator.

15. The arrangement defined in claim 1 further comprising additional weight means whereby the user may perform selected exercises, said weight means being accessible to the user by means of an preselected arrangement of handles, cables and pulleys mounted in a preselected position on said base.

16. The arrangement defined in claim 1 wherein said base further comprises a preselected number of generally L shaped supports securely held spaced apart by a preselected number of spacers, the apex of said L shaped supports having a pivotal mount whereby said platform may be attached to said L shaped supports and rotated to a preselected attitude.

17. The arrangement defined in claim 16 wherein each leg of said L shaped support is hingedly connected at the apex of the L and further comprises articulated arm supports mounted to each leg to securely hold each leg of said L shaped supports in a spaced apart configuration whereby said support may be folded for storage.

* * * * *